US005245899A

United States Patent [19]

Röhe

[11] Patent Number: 5,245,899

[45] Date of Patent: Sep. 21, 1993

[54] CROSSCUTTING DEVICE FOR WEBS OF MATERIAL, PARTICULARLY TEXTILE WEBS

[75] Inventor: Peter Röhe, Ochtrup, Fed. Rep. of Germany

[73] Assignee: Carl Schmale GMBH & Co. KG, Ochtrup, Fed. Rep. of Germany

[21] Appl. No.: 820,596

[22] PCT Filed: Jul. 7, 1990

[86] PCT No.: PCT/DE90/00511

§ 371 Date: Jan. 21, 1992

§ 102(e) Date: Jan. 21, 1992

[87] PCT Pub. No.: WO91/01402

PCT Pub. Date: Feb. 7, 1991

[30] Foreign Application Priority Data

Jul. 18, 1989 [DE] Fed. Rep. of Germany ... 8908720[U]

[51] Int. Cl.[5] ..... D06H 7/02

[52] U.S. Cl. ..... 83/76.8; 83/167; 83/206; 83/368; 83/488; 83/573; 83/937

[58] Field of Search ..... 83/167, 76.8, 206, 280, 83/364, 368, 508, 614, 936, 937, 573, 571, 485, 487, 488; 30/275; 270/30, 31

[56] References Cited

U.S. PATENT DOCUMENTS

| | | | |
|---|---|---|---|
| 2,727,571 | 12/1955 | Sayles | 83/487 X |
| 3,823,629 | 7/1974 | Bleimund | 83/280 X |
| 4,073,206 | 2/1978 | Gratsch et al. | 83/508 X |
| 4,088,099 | 5/1978 | Benedict | 83/614 X |
| 4,155,543 | 5/1979 | Costigan | 270/30 |
| 4,392,646 | 7/1983 | Costigan | 270/30 |
| 4,779,500 | 10/1988 | Bennett et al. | 83/649 X |
| 4,981,059 | 1/1991 | Kobayashi | 83/508 X |
| 4,982,940 | 1/1991 | Jung | 270/31 X |
| 5,024,429 | 6/1991 | Etcheparre et al. | 270/30 |

*Primary Examiner*—Frank T. Yost
*Assistant Examiner*—Rinaldi Rada
*Attorney, Agent, or Firm*—Herbert Dubno

[57] ABSTRACT

A crosscutting device for webs of material, particularly textile webs includes a web feed with a web buffer arranged on a common frame with the cutting station, a cutting station with a rotating disk cutter, driven transport nippers and a tray for stacking the cut material, the rotating disk cutter being automatically moved back and forth across the web by means of a disengageable belt in one of the operating modes and in a second operating mode the disk cutter being movable manually across the web and at the same time also in the running direction of the web.

22 Claims, 5 Drawing Sheets

CROSSCUTTING DEVICE FOR WEBS OF MATERIAL, PARTICULARLY TEXTILE WEBS

CROSS REFERENCE TO RELATED APPLICATIONS

This application is a National Phase application corresponding to U.S. Pat. No. PCT/DE90/00511 filed Jul. 7, 1990 and based in turn, upon an U.S. patent application Ser. No. G 89 08 720.8 filed in Germany under the International Convention.

FIELD OF THE INVENTION

The invention relates to a crosscutting device for webs of material, particularly textile webs, including a web feed with a web buffer mounted on a common frame with the cross cutting device, a cutting station with a rotating disk cutter, driven transport nippers and a tray for stacking the cut material.

BACKGROUND OF THE INVENTION

The DE-OS 30 24 389 discloses a crosscutting device which can cut pieces of equal length, e.g. for manufacturing towels, from a running textile web. For this purpose, the cutting zone is stressed by clamping bars which can be lowered on the napless zones.

However, it has been proven that in an automatic operation the textile webs are often not sufficiently aligned, so that continuous realignment is required.

The DD-PS 126 280 relates to a device for aligning and crosscutting textile webs according to thread, whereby the alignment means react to thickness variations in the textile web.

The DE-GM 87 04 588 refers to a crosscutting device for textile webs with a rotating disk cutter travelling back and forth across the textile web.

The EP-A-89006 relates to a pattern-cutting machine, particularly a clothier's cutting machine, wherein several layer of the materials to be cut are stacked one on top of the other on a support table and ar cut according to the lines of the layout pattern by a so-called pinion-type cutter. Thereby, the fabric layers are stationary on the support table. The cutting tool is provided with a handle and is fastened by means of a parallelogram guide to a carriage which can travel in the longitudinal and transverse directions of the support table. During cutting, the cutting tool can be moved along the cutting lines of the pattern by means of the handle, whereby this manual cutting operation is servo-assisted by a very expensive control system. This way the clothier's cutting machine has only one operating mode, namely the servo-assisted manual mode of operation.

It has been established that the efficiency of a comparatively expensive crosscutting device could be greatly improved by adding the possibility of manual operation to the automatic operation, since frequently there are textile webs with nonlinear cutting lines which can be cut only manually.

Therefore it is the object of the invention to improve the known crosscutting device so that on the same machine it is possible to perform not only automatic operations, but also a manually guided cutting along any desired cutting lines.

This problem is solved by the characteristic feature defined in the main claim. The dependent claims contain further suitable developments and variants.

Due to the device according to the invention it become possible in the same machine either to crosscut automatically running and measured textile webs or to guide the cutting knife manually according to premarked cutting lines. Thereby, the operator can conveniently guide the disk cutter and monitor the running path of the cutter. During the automatic operation time losses are largely avoided and high working speeds are insured. During the manual operating mode it is possible to perform a precise cutting even along difficult cutting lines rich in curves, because the distance between the eye of the operator and the position of the knife is always almost constant.

SUBJECT OF THE INVENTION

Therefore it is the object of the invention to improve the known crosscutting device so that the machine can perform automatic and manually guided cutting operations along any desired cutting lines.

SUMMARY OF THE INVENTION

This problem is solved by the apparatus including a web feed with a web buffer arranged on a common frame with the cutting station, a cutting station with a rotating disk cutter, driven transport nippers and a tray for stacking the cut material, the rotating disk cutter being automatically moved back and forth across the web by means of a disengageable belt in out of the operating modes and in a second operating mode the disk cutter being movable manually across the web and at the same time in the running direction of the web.

Due to the device according to the invention it becomes possible in the same machine both to crosscut automatically running and measured textile webs and/or to guide the cutting knife manually according to premarked cutting lines. Thereby, the operator can conveniently guide the disk cutter and monitor the running path of the cutter. During the automatic operation time losses are largely avoided and high working speeds are insured. During the manual operating mode it is possible to perform a precise cutting even along difficult cutting lines rich in curves, because the distance between the eye of the operator and the position of the knife is always almost constant.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
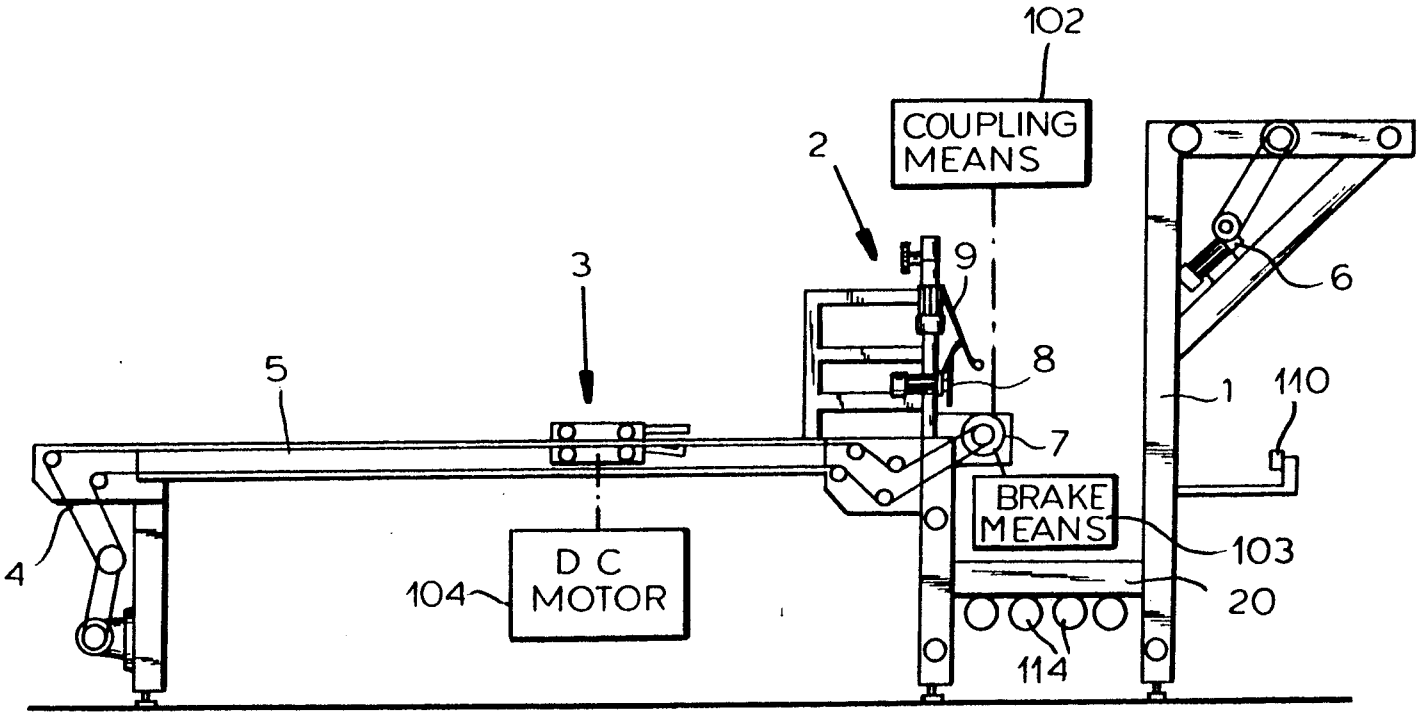
FIG. 1 is an elevational side view.

FIG. 1 shows a general view of the crosscutting device with the web feed 1 mounted on a common frame with the cutting station 2 and comprising a driving motor 6 and the usual web buffer for textile webs.

The cutting station 2 is equipped with a rotating disk cutter 8 travelling back and forth across the frame and the web. The disk cutter 8 works in two opposite directions, i.e. the cutting knife stops after the first step, without idly travelling back to its initial position. The second cut can take place directly in the opposite direction, after a further web advance. Such operation is time efficient and provides high delivery speeds of the web 7 in approximately 5-90 m/min. The cutting can be steplessly set and controlled by means of a potentiometer control and the driving motor 6. The goods are fed almost stressfree to the cutting station 2, whereby their delivery is controlled by photoelectric cells 110.

The disk cutter 8 is suitably provided with an elastically supported counterknife made of Widia metal, whereby a long cutting and service life of the knife can be achieved. The disk cutter 8 is guided on a carriage 11 (FIG. 2) which is arranged transversely with respect to the running direction of the web, whereby for the automatic operation in the automatic mode of the device on both sides of the carriage 11, limit switches 19 (FIGS. 2, 3) are provided, which are mounted adjustably on a guide rail 13 corresponding with the respective web width and disconnecting the driving motor 18 of the disk cutter 8 when the latter reaches respective limits.

The disk cutter 8 is equipped with a magnifying auxiliary optical device 29 (FIG. 5), in order to facilitate the manual cutting in the respective manual mode of operation. The optical device 29 has windows on both sides of the disk cutter 8 provided with markings which during the cutting operation have to coincide with the respective cutting marks on the textile web to a precise cutting.

The cutting station 2 is designed so that the rotating disk cutter 8 can be moved automatically back and forth across the web of material by means of a belt 10 (FIG. 2) in the automatic mode, while in the manual mode the disk cutter 8 can be moved manually across the web and at the same time also in the longitudinal direction of the web as will be described herebelow.

The disk cutter 8 together with its driving motor 18 (FIG. 2) is supported in a carriage 17, which in turn can be manually moved in the running direction of the web indicated by an arrow A on a guide rail 16 of the carriage 11 while the carriage 11 is at the same time manually movable across the web along a rail 13 mounted fixed in the direction of the web running. The belt 10 is engageable with the carriage 11 by any convenient means 100 in the automatic mode of the device.

In the common frame between the web feed 1 and the cutting station 2, a service platform 20 with rollers 114 are provided. The web of material can be guided via rollers 114 towards a positioning roller 7.

Figure 2:
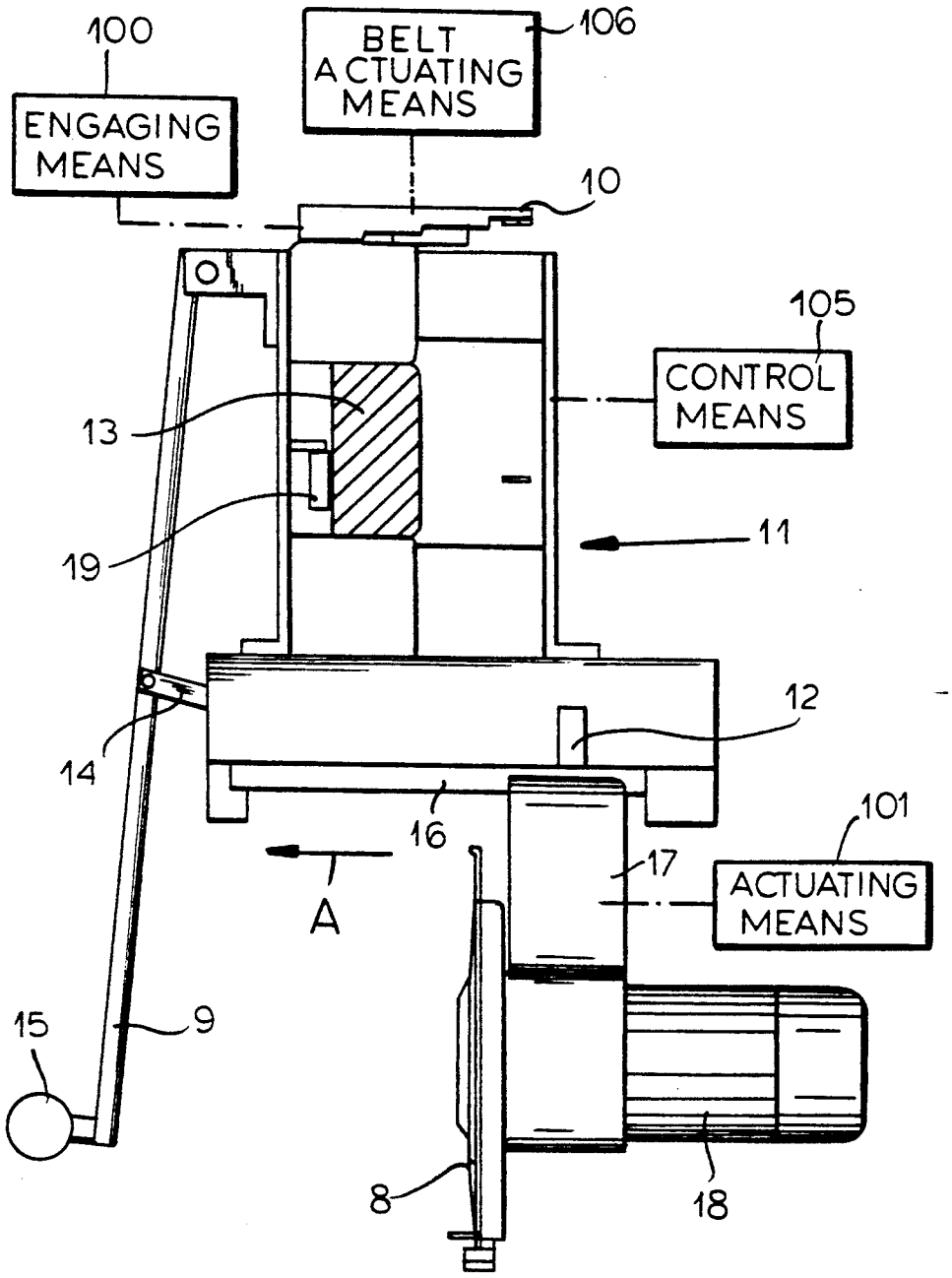
FIG. 2 is a detailed longitudinal section of view with the cutting disk and the manual control.

FIG. 2 shows a rod assembly 9, 14 serving for the manual operation of the cutting station 2. By means of these rods 9, 14, the cutting knife carriage 17 can be moved in the running direction of the web along the guide rail 16. The rod part 9 has at its lower end a hand knob 15, while the rod 14 is operatively connected with the carriage 17 so the latter can travel along the rail 16 upon pulling of the handle 15.

An endless belt 4 driven by a motor moves the transport nippers 3 and at the same time drives the positioning roller 7. The belt 4 can be disengaged from the positioning roller 7 by a time-adjustable coupling means 102. Thereby, also a brake 103 for the positioning roller 7 is provided. Suitably, the positioning roller 7 is covered by an adhesive layer. A brake means 112 is provided for fixing the positioning roller in the manual mode of operations.

By choice the transport nippers can also be driven by an electrically adjustable direct-current motor 104.

Figure 3:
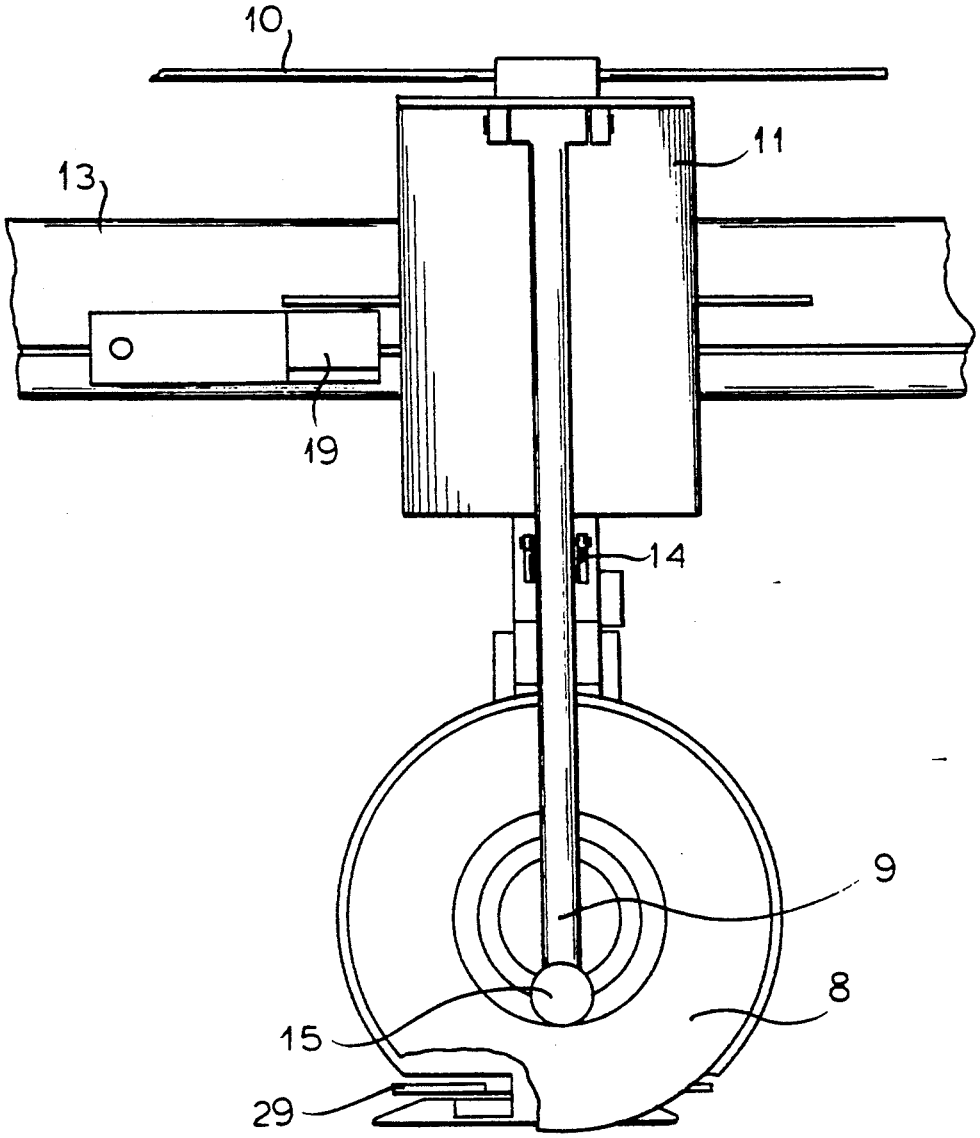
FIG. 3 is a detailed axial view along the axis of the cutting disk.

FIG. 3 represents a side view of the disk of disk cutter 8. Thereby, the rod assembly 9, 14 for the manual guidance of the cutter can also be seen: The rod portion 9 is linked to the carriage 11. The engaging means 100 is provided on carriage 11 which can be connected to engage the belt 10. The rod assembly 9, 14 can be secured in place during the automatic cross-cutting of unmeasured goods, whereby a sensor 12 (FIG. 2) is provided for monitoring this fixed position of the rods. An actuating means 101 is provided for displacing the cutter 8 with the motor 18 and carriage 17 along the rail 16 in the direction of the running web A in the automatic mode of the device. The belt 10 providing a cross movement of the carriage 11 in the automatic mode is actuated by respective actuating means 106 shown in FIG. 2.

Figure 4:
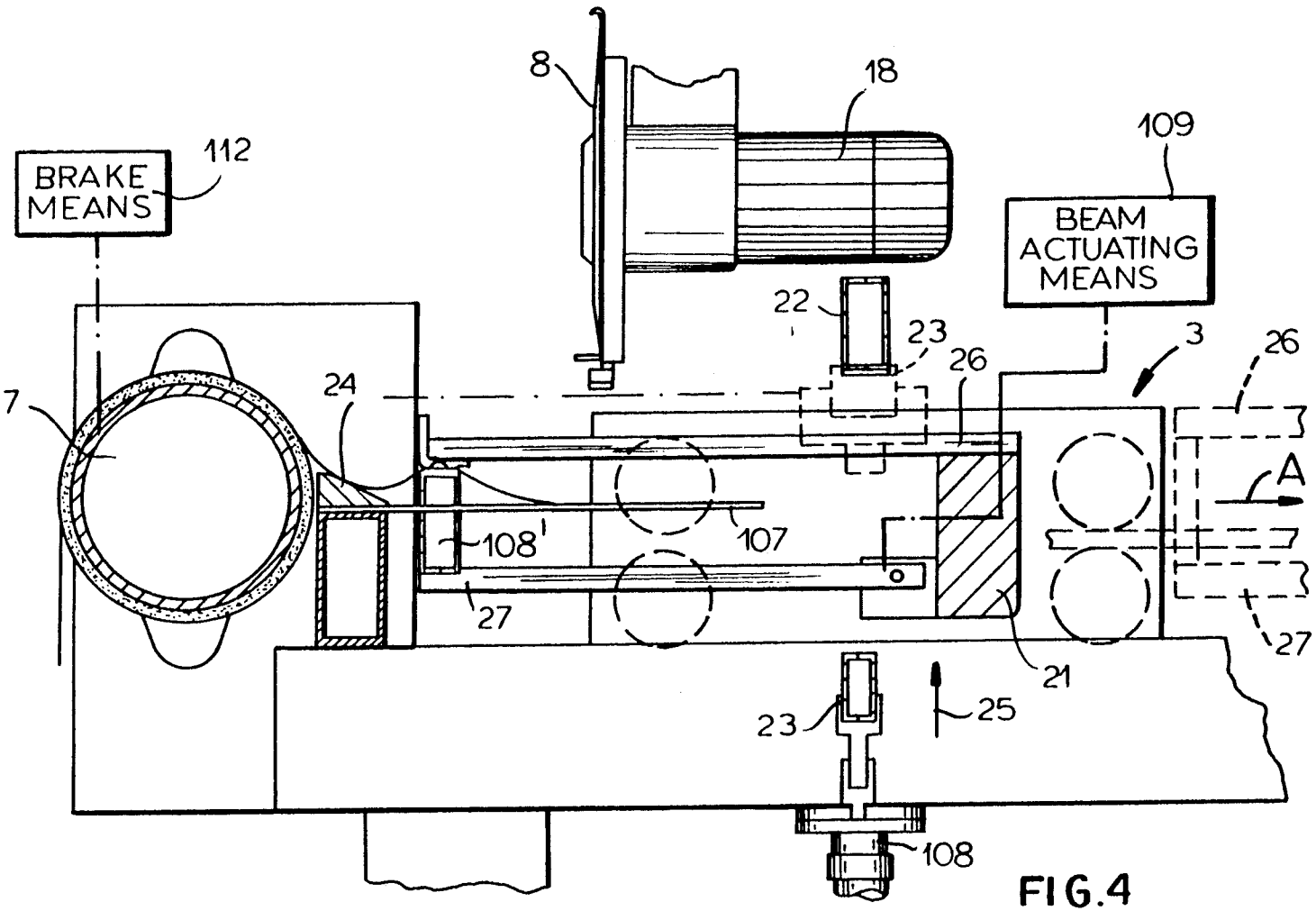
FIG. 4 is a longitudinal sectional transverse view along IV—IV in FIG. 5.
Figure 5:
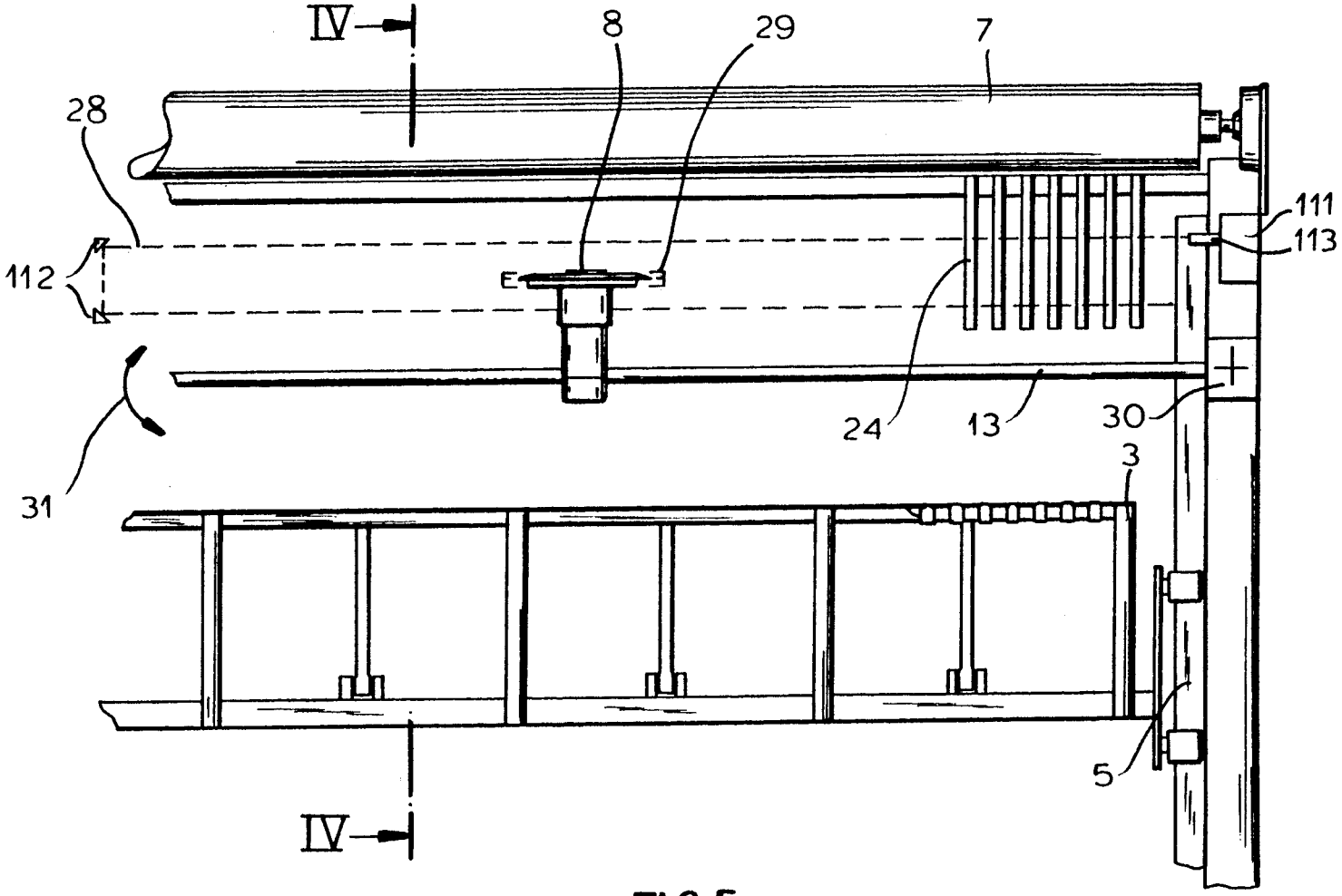
FIG. 5 is a top view of the device.

FIG. 4 shows a section through the device along line IV—IV in FIG. 5. Thereby, the transport nippers 3 can be seen, which are horizontally movable on the transport nippers guide 5 (FIGS. 1, 5).

As is seen in FIG. 4 a lower beam is pivotally mounted as a frame 21 and is provided with a damping element 108 mounted on a free end of the beam, so upon pivoting the lower beam by a beam actuating means 109 the element is in contact with an upper beam 26 and a web is nipped in between.

The transport nippers system regulates the web delivery in the programmed length from a minimum of approximately 50 cm to the maximum work length of the device. The impact of the nipper system at the end points takes place in slow motion. Downstream of the positioning roller 7 in the direction of web delivery, a support cam 24 with respective tongues 107 supporting a cut web (FIGS. 4, 5) are provided. The transport nippers 3 consist basically of the support plate 21 with the upper beam 26 and the lower beam 27, whereby the upper beam 26 is rigidly fastened to the support plate 21 and the lower beam 27 is movably fastened to the same in order to clamp the material. For the stretching of the web a rigid upper clamping rail 22 and a lower clamping rail 23 pneumatically actuatable in the direction of arrow 25 are provided, upon withdrawing of the transport nippers in a direction indicated by arrow A and shown in dash lines in FIG. 4 so that the lower edge of the clamping rail 22 is located approximately at the height of the point where the web is taken off the positioning roller 7 and that the fabric web lies approximately horizontally during the cutting process and is clamped by the countermotion of the lower clamping rail 23 mounted on a movable support 108, in turn operatively connected with the frame.

FIG. 5 shows a top view of the device. The cutting range of the disk cutter 8 is marked by visible laser lines 28 realized by mounting of laser means 111 emitting the beams reflected by mirrors 112. A sensor 113 provides tracing of the cutter within the limited range delimited by laser lines in the manual mode of operation, in order to move manually the fabric web with its markings of cutting lines within this range by means of a control key.

For cutting textile webs along nonlinear cutting edges, a sensor is provided on the disk cutter 8 which optically scans the marked cutting lines in order to insure their tracing by the disk cutter 8 on the guide rail 16.

The guide rail 13 is adjustable about an axis 30 in the direction of arrow 31 in order to insure an automatic cutting of textile webs following the warp thread as closely as possible. This operation is known in the art.

The crosscutting device is equipped with a control 105 with program storage lodged in a switch box pertaining to the machine.

The cut goods can be stacked on a transport block located under the frame of the device.

I claim:

1. An apparatus for crosscutting a web of material comprising:

a frame;

feeding means on said frame for supplying a web to be cut in a travel direction along a path thereof;

nipping means mounted movably on said frame downstream of said feeding means for engaging a free end of the web and stretching the web at a length in said travel direction;

a cutting station mounted on said frame along said path between said nipping and feeding means, said station being provided with:

a guide rail mounted on said frame, a housing mounted slidably reciprocatingly on said guide rail in a cutting direction generally perpendicular to said travel direction and provided with a bottom, a guide mounted on said bottom of said housing, a carriage mounted slidably in said travel direction on said guide, a disc cutter provided with a motor and mounted on said carriage for crosscutting said web in said cutting direction, actuating means including a belt for displacing automatically said housing and said carriage in said cutting direction in a first automatic mode of operation of said apparatus, engaging means for selectively engaging said belt with said disc cutter performing one cut per stroke in the first mode of operations, said belt being disengaged from said disc cutter in a second manual mode of operations of said apparatus, and means operatively connected with said disc cutter for manually displacing said carriage reciprocatingly on said guide in said travel direction simultaneously with displacing of said housing in said cutting direction in the second manual mode of operations for crosscutting the web by said disc cutter.

2. The apparatus defined in claim 1 wherein said guide rail is mounted pivotally on said frame about a respective axis extending vertically perpendicular to said path.

3. The apparatus defined in claim 1 wherein said coupling means includes:

a first rod mounted pivotally on said housing about a respective axis extending in said cutting direction;

a second rod operatively connected with said carriage and with said first rod, said second rod displacing said carriage along the guide upon swinging of said first rod; and means for fixedly connecting said first and second rods in said first mode with said housing.

4. The device defined in claim 3 further comprises means for controlling said means for fixedly connecting said rods in said first mode.

5. The apparatus defined in claim 1 wherein said feeding means includes:

a web driving motor;

a plurality of guiding rollers;

at least one endless motor-driven belt guided along said rollers by said web motor, and a positioning roller mounted on said frame upstream of said cutting station, said positioning roller and said nipping means being operatively connectable with said endless belt.

6. The device defined in claim 5 wherein said nipping means is driven by said belt.

7. The device defined in claim 5 wherein said nipping means is driven by an electrically adjusted DC motor.

8. The apparatus defined in claim 5, further comprises means for disengaging said positioning roller from said belt.

9. The device defined in claim 5 wherein said positioning roller is covered with an adhesive layer.

10. The device defined in claim 5 wherein said feeding means further includes monitoring means including at least one web sensor for monitoring a supply of said web.

11. The device defined in claim 1 wherein said nipping means includes:

a support plate lying in a respective plane extending perpendicular to said path;

an upper beam mounted fixed on said support and extending parallel to said path;

a lower beam mounted pivotally on said support and pivotal toward said upper beam, a free end of said lower beam being provided with a clamping element engaging said free end of the web with said upper beam, said support plate being displaceable along said path downstream from said cutting station upon engaging of said web; and tensioning means for stretching said web and including:

an upper rail fixed on said frame and lying in a respective plane above said path, a lower rail operatively connected with said frame, and pneumatic means for actuating said lower rail movable perpendicular to said path upwardly toward said upper rail to engage said web therebetween upon displacing said support plate.

12. The apparatus defined in claim 1, further comprising a support cam mounted fixed on said frame next to said cutting station and provided with a plurality of tongues lying in said cutting plane and supporting said web upon cutting.

13. The apparatus defined in claim 1 wherein said cutting station is provided with:

limit switches for limiting a path of said disc cutter in said first mode across the web in said cutting plane; and means on said cutting station for displacing said limit switches, so that said path of said cutter is controllable and said actuating means is automatically switched off upon reaching said switches by said cutter.

14. The device defined in claim 1 wherein said frame is provided with laser means for generating a laser beam and including:

a source of said beam, a plurality of mirrors reflecting said beam, so that a cutting range of said cutter is marked by visible laser marks in said second mode, and a control sensor for tracing said laser marks in said second mode.

15. The device defined in claim 1 wherein said cutter is provided with magnifying means for magnifying crosscutting marks on said web.

16. The device defined in claim 15 wherein said magnifying means is provided with respective marking lines, said magnifying means includes a pair of windows each provided with respective guiding lines and means for automatically aligning said guiding lines with said crosscutting marks.

17. The device defined in claim 1, further comprising means for generating a signal corresponding to respective beginning and end of each of a plurality of crosscutting marks on said web in said second mode along which said web is cut.

18. An apparatus for crosscutting a web of material comprising:

a frame;

feeding means on said frame for supplying a web to be cut in a travel direction along a path thereof;

a cutting station downstream of said feeding means on said frame provided with:

a guide rail operatively connected with said frame, a housing mounted slidably on said rail, and a disc cutter crosscutting said web in a cutting direction generally perpendicular to said travel direction and operatively connected with said housing, and nipping means mounted movably on said frame downstream of said cutting station for engaging a free end of said web and stretching the web at a length in said travel direction;

means including a disengageable belt for selectively engaging a belt with said disc cutter in a first mode of operations of said apparatus, said disc cutter being disconnected from said belt in a second mode of operations of said apparatus;

means operatively connected with said housing for enabling manual reciprocating displacement of said disc cutter in said travel direction and in said cutting direction simultaneously with said housing in said second mode of operations for cutting said web along a plurality of crosscutting marks on said web spaced from one another along the path in said web;

switching means operatively connected with said cutting station and including a plurality of limit switches mounted on said guide rail for defining an effective cutting path of said disc cutter with said housing in said cutting direction; and adjusting means on said guide rail for displacing said limit switches relative one another in said cutting direction, so that said path is varied in response to a corresponding width of the web.

19. An apparatus for crosscutting a web of material comprising:

a frame;

feeding means on said frame for supplying a web to be cut in a travel direction along a path thereof;

a cutting station downstream of said feeding means on said frame provided with a disk cutter crosscutting said web in a cutting direction generally perpendicular to said travel direction and having a cutting range;

nipping means mounted movably on said frame downstream of said cutting station for engaging a free end of said web and stretching the web at a length in said travel direction;

actuating means including a disengageable belt for displacing said cutting station with said disc cutter in said cutting direction;

engaging means for selectively engaging said belt with said disc cutter in a first mode of operations of said apparatus, said disc cutter being disconnected from said belt in a second mode of operations of said apparatus;

means operatively connected with said cutting station for enabling manual reciprocating displacement of said disc cutter relative to said cutting station in said travel direction and said station in said cutting direction simultaneously in said second mode of operations for cutting said web along a plurality of crosscutting marks on said web spaced from one another along the path in said web; and laser means including a plurality of sensors and operatively connected with said cutting station for marking said cutting range of said disc cutter with visible laser lines in said second mode.

20. An apparatus for crosscutting a web of material comprising:

a frame;

feeding means on said frame for supplying a web to be cut in a travel direction along a path thereof;

a rail guide mounted pivotally about an axis skewed to said travel direction on said frame downstream of said feeding station;

a cutting station mounted reciprocatingly slidably in a cutting direction generally perpendicular to said travel direction on said rail guide and provided with a disc cutter;

nipping means mounted movably on said frame downstream of said cutting station for engaging a free end of said web and stretching the web at a length in said travel direction;

actuating means including a disengageable belt for displacing said cutting station with said disc cutter in said cutting direction;

engaging means for selectively engaging said belt with said disc cutter in a first mode of operations of said apparatus, said guide rail following closely a warp thread in said first mode by pivoting about said axis, said disc cutter being disconnected from said belt in a second mode of operations of said apparatus; and coupling means operatively connected with said cutting station for enabling manual reciprocating displacement of said disc cutter relative to said cutting station in said travel direction and reciprocatingly displacing said station in said cutting direction simultaneously with said disc cutter in said second mode of operations for cutting said web along a plurality of crosscutting marks on said web spaced from one another along the path in said web.

21. An apparatus for crosscutting a web of material comprising:

a frame;

a rail guide mounted on said frame;

feeding means on said frame for supplying a web to be cut in a travel direction along a path thereof;

a cutting station downstream of said feeding means on said frame provided with a disc cutter mounted on said guide crosscutting said web in a cutting direction generally perpendicular to said travel direction;

nipping means mounted movably on said frame downstream of said cutting station for engaging a free end of said web and stretching the web at a length in said travel direction;

actuating means including a disengageable belt for displacing said cutting station said and disc cutter in said cutting direction;

engaging means for selectively engaging said belt with said disc cutter in a first mode of operations of said apparatus, said disc cutter being disconnected from said belt in a second mode of operations of said apparatus;

means for enabling manual reciprocating displacement of said disc cutter relative to said cutting station in said travel direction along said guide and in said cutting direction simultaneously with said station in said second mode of operations for cutting said web along a plurality of crosscutting marks on said web spaced from one another along the path in said web; and means mounted on said disc cutter for optically scanning each of said crosscutting marks on said web in said second mode and for guiding said disc cutter toward each of said marks along said guide.

22. An apparatus for crosscutting a web of material comprising:

a frame;

feeding means on said frame for supplying a web to be cut in a travel direction along a path thereof;

a cutting station downstream of said feeding means on said frame provided with a disc cutter crosscutting said web in a cutting direction generally perpendicular to said travel direction;

nipping means mounted movably on said frame downstream of said cutting station for engaging a free end of said web and stretching the web at a length in said travel direction;

actuating means including a disengageable belt for displacing with said cutting station with said disc cutter in said cutting direction;

engaging means for selectively engaging said belt with said disc cutter in a first mode of operations of said apparatus, said disc cutter being disconnected from said belt in a second mode of operations of said apparatus; and means operatively connected with said cutting station for enabling manual reciprocating displacement of said disc cutter relative to said cutting station in said travel direction simultaneously with displacing said cutting station in said cutting direction in said second mode of operations for cutting said web along a plurality of crosscutting marks on said web spaced from one another along the path in said web.

* * * * *